US006529867B2

(12) United States Patent
Gao

(10) Patent No.: US 6,529,867 B2
(45) Date of Patent: Mar. 4, 2003

(54) INJECTING HIGH FREQUENCY NOISE INTO PULSE EXCITATION FOR LOW BIT RATE CELP

(75) Inventor: Yang Gao, Mission Viejo, CA (US)

(73) Assignee: Conexant Systems, Inc., Newport Beach, CA (US)

( * ) Notice: Subject to any disclaimer, the term of this patent is extended or adjusted under 35 U.S.C. 154(b) by 27 days.

(21) Appl. No.: 09/755,441

(22) Filed: Jan. 5, 2001

(65) Prior Publication Data

US 2002/0128828 A1 Sep. 12, 2002

Related U.S. Application Data

(60) Provisional application No. 60/233,043, filed on Sep. 15, 2000.

(51) Int. Cl.[7] ..... G10L 19/14; G10L 19/12

(52) U.S. Cl. ..... 704/223; 704/226

(58) Field of Search ..... 704/201, 208, 704/219–223, 226–228, 214

(56) References Cited

U.S. PATENT DOCUMENTS 5,692,102 A * 11/1997 Pan ..... 704/230
5,699,477 A * 12/1997 McCree ..... 704/219
5,966,689 A * 10/1999 McCree ..... 704/219
5,991,717 A * 11/1999 Minde et al. ..... 704/223
6,134,518 A * 10/2000 Cohen et al. ..... 704/219
6,240,386 B1 * 5/2001 Thyssen et al. ..... 704/220

OTHER PUBLICATIONS

Laroche et al., :HNS: Speech Modification Based on a Harmonic+Noise Model, IEEE, 1993, pp. II–550 to II–553.*

* cited by examiner

*Primary Examiner*—David D. Knepper
(74) *Attorney, Agent, or Firm*—Farjami & Farjami LLP

(57) ABSTRACT

A filtered noise is generated by passing a high frequency noise signal through a high pass filter. The filtered high frequency noise is injected in to the pulse output of the codebook through convolution. The combined noise signal and pulse output generates a perceptually enhanced encoded speech signal.

33 Claims, 5 Drawing Sheets

INJECTING HIGH FREQUENCY NOISE INTO PULSE EXCITATION FOR LOW BIT RATE CELP

CROSS REFERENCE TO RELATED APPLICATIONS

This application claims the benefit of Provisional Application No. 60/233,043 filed on Sep. 15, 2000. The following co-pending and commonly assigned U.S. patent applications have been filed on the same day as this application. All of these applications relate to and further describe other aspects of the embodiments disclosed in this application and are incorporated by reference in their entirety.

U.S. patent application Ser. No. 09/663,242, "SELECTABLE MODE VOCODER SYSTEM," Attorney Reference Number: 98RSS365CIP (10508.4), filed on Sep. 15, 2000.

U.S. patent application Ser. No. 09/771,293, "SHORT TERM ENHANCEMENT IN CELP SPEECH CODING," Attorney Reference Number: 00CXT0666N (10508.6), filed on Sep. 15, 2000.

U.S. patent application Ser. No. 09/761,029, "SYSTEM OF DYNAMIC PULSE POSITION TRACKS FOR PULSE-LIKE EXCITATION IN SPEECH CODING," Attorney Reference Number: 00CXT0573N (10508.7), filed on Sep. 15, 2000.

U.S. patent application Ser. No. 09/782,791, "SPEECH CODING SYSTEM WITH TIME-DOMAIN NOISE ATTENUATION," Attorney Reference Number: 00CXT0554N (10508.8), filed on Sep. 15, 2000.

U.S. patent application Ser. No. 09/761,033 "SYSTEM FOR AN ADAPTIVE EXCITATION PATTERN FOR SPEECH CODING," Attorney Reference Number: 98RSS366 (10508.9), filed on Sep. 15, 2000.

U.S. patent application Ser. No. 09/782,383, "SYSTEM FOR ENCODING SPEECH INFORMATION USING AN ADAPTIVE CODEBOOK WITH DIFFERENT RESOLUTION LEVELS," Attorney Reference Number: 00CXT0670N (10508.13), filed on Sep. 15, 2000.

U.S. patent application Ser. No. 09/663,837, "CODEBOOK TABLES FOR ENCODING AND DECODING," Attorney Reference Number: 00CXT0669N (10508.14), filed on Sep. 15, 2000.

U.S. patent application Ser. No. 09/662,828, "BIT STREAM PROTOCOL FOR TRANSMISSION OF ENCODED VOICE SIGNALS," Attorney Reference Number: 00CXT0668N (10508.15), filed on Sep. 15, 2000.

U.S. patent application Ser. No. 09/781,735, "SYSTEM FOR FILTERING SPECTRAL CONTENT OF A SIGNAL FOR SPEECH ENCODING," Attorney Reference Number: 00CXT0667N (10508.16), filed on Sep. 15, 2000.

U.S. patent application Ser. No. 09/663,734, "SYSTEM FOR ENCODING AND DECODING SPEECH SIGNALS," Attorney Reference Number: 00CXT0665N (10508.17), filed on Sep. 15, 2000.

U.S. Patent application Ser. No. 09/633,002, "SYSTEM FOR SPEECH ENCODING HAVING AN ADAPTIVE FRAME ARRANGEMENT," Attorney Reference Number: 98RSS384CIP (10508.18), filed on Sep. 15, 2000.

U.S. patent application Ser. No. 09/940,904, "SYSTEM FOR IMPROVED USE OF PITCH ENHANCEMENT WITH SUB CODEBOOKS," Attorney Reference Number: 00CXT0569N (10508.19), filed on Sep. 15, 2000.

BACKGROUND OF THE INVENTION

1. Field of the Invention

This invention relates to speech coding, and more particularly, to a system that enhances the perceptual quality of digital processed speech.

2. Related Art

Speech synthesis is a complex process that often requires the transformation of voiced and unvoiced sounds into digital signals. To model sounds, the sounds are sampled and encoded into a discrete sequence. The number of bits used to represent the sounds can determine the perceptual quality of synthesized sound or speech. A poor quality replica can drown out voices with noise, lose clarity, or fail to capture the inflections, tone, pitch, or co-articulations that can create adjacent sounds.

In one technique of speech synthesis known as Code Excited Linear Predictive Coding (CELP) a sound track is sampled into a discrete waveform before being digitally processed. The discrete waveform is then analyzed according to certain select criteria. Criteria such as the degree of noise content and the degree of voice content can be used to model speech through linear functions in real and in delayed time. These linear functions can capture information and predict future waveforms.

The CELP coder structure can produce high quality reconstructed speech. However, coder quality can drop quickly when its bit rate is reduced. To maintain a high coder quality at a low bit rate, such as 4 Kbps, additional approaches must be explored. This invention is directed to providing an efficient coding system of voiced speech and to a method that accurately encodes and decodes the perceptually important features of voiced speech.

SUMMARY

This invention is a system that seamlessly improves the encoding and the decoding of perceptually important features of voiced speech. The system uses modified pulse excitations to enhance the perceptual quality of voiced speech at high frequencies. The system includes a pulse codebook, a noise source, and a filter. The filter connects an output of the noise source to an output of the pulse codebook. The noise source may generate a white noise, such as a Gaussian white noise, that is filtered by a high pass filter. The pass band of the filter passes a selected portion of the white Gaussian noise. The filtered noise is scaled, windowed, and added to a single pulse to generate an impulse response that is convoluted with the output of the pulse codebook.

In another aspect, an adaptive high-frequency noise is injected into the output of the pulse codebook. The magnitude of the adaptive noise is based on a selectable criteria such as the degree of noise like content in a high-frequency portion of a speech signal, the degree of voice content in a sound track, the degree of unvoiced content in a sound track, the energy content of a sound track, the degree of periodicity in a sound track, etc. The system generates different energy or noise levels that targets one or more of the selected criteria. Preferably, the noise levels model one or more important perceptual features of a speech segment.

Other systems, methods, features and advantages of the invention will be or will become apparent to one with skill in the art upon examination of the following figures and detailed description. It is intended that all such additional systems, methods, features and advantages be included within this description, be within the scope of the invention, and be protected by the accompanying claims.

BRIEF DESCRIPTION OF THE FIGURES

The components in the figures are not necessarily to scale, emphasis instead being placed upon illustrating the principles of the invention. Moreover, in the figures, like reference numerals designate corresponding parts throughout the different views.

The dashed lines drawn in FIGS. 1, 2, and 6 represent direct and indirect connections. As shown in FIG. 2, the fixed codebook 102 can include one or more subcodebooks. Similarly, the dashed lines of FIG. 6 illustrate that other functions can occur before or after each illustrated step.

DETAILED DESCRIPTION

Pulse excitations typically can produce better speech quality than conventional noise excitation for voiced speech. Pulse excitations track the quasi-periodic time-domain signal of voiced speech at low frequencies. At high frequencies, however, low bit rate pulse excitations often cannot track the perceptual "noisy effect" that accompanies voiced speech. This can be a problem especially at very low bit rates such as 4 Kbps or lower rates for example where pulse excitations must track, not only the periodicity of voiced speech, but also the accompanying "noisy effects" that occur at higher frequencies.

Figure 1:
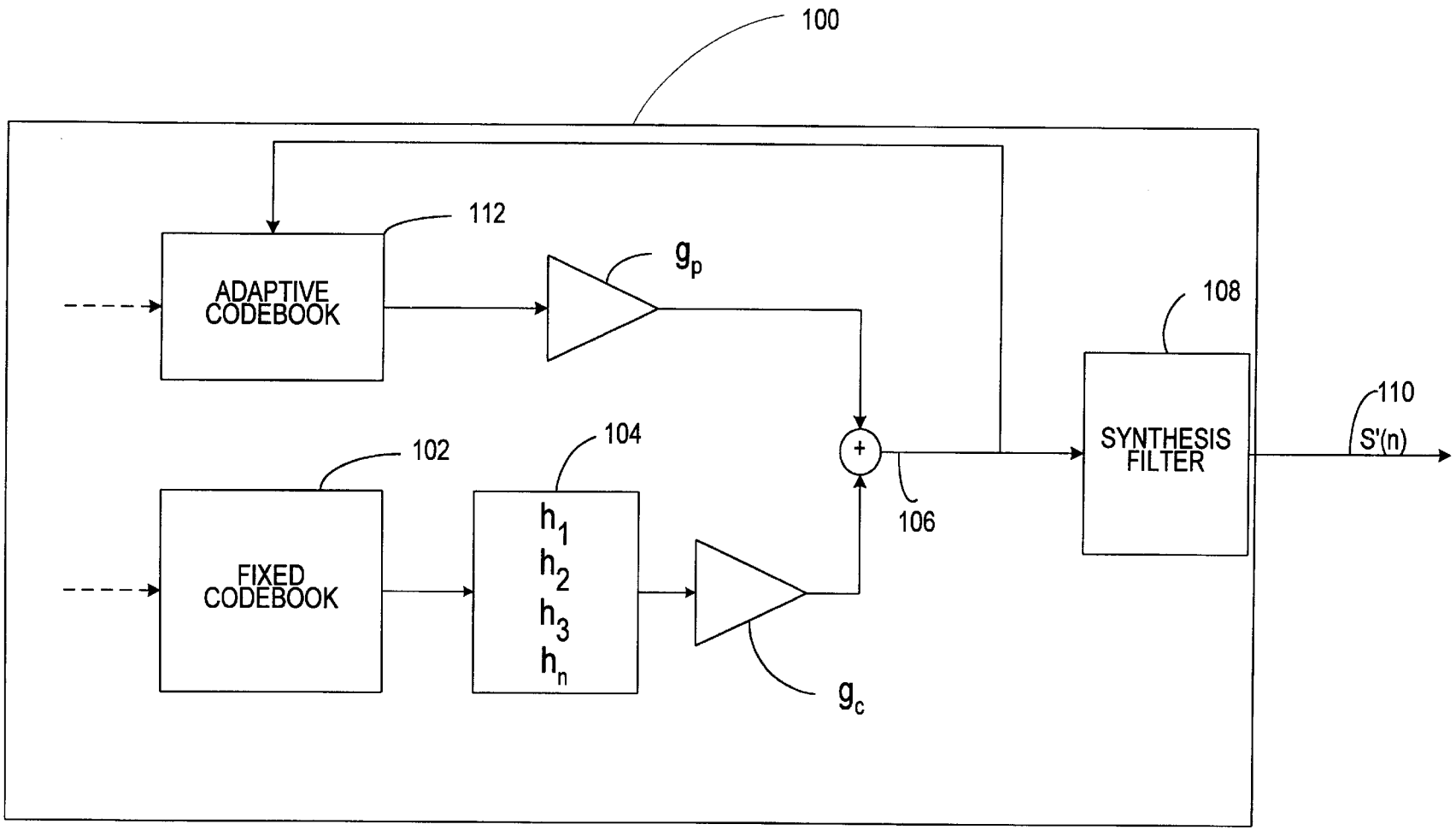
FIG. 1 is a partial block diagram of a speech communication system that may be incorporated in an eXtended Code Excited Linear Prediction System (eX-CELPS).

FIG. 1 is a partial block diagram of a speech communication system 100 that may be incorporated in a variant of a Code Excited Linear Prediction System (CELPS) known as the eXtended Code Excited Linear Prediction System (eX-CELPS). Conceptually, eX-CELP achieves toll quality at a low bit rate by emphasizing the perceptually important features of a sampled input signal (i.e., a voiced speech signal) while de-emphasizing the auditory features that are not perceived by a listener. Using a process of linear predictions, this embodiment can represent any sample of speech. The short-term prediction of speech s at an instant n can be approximated by Equation 1:

$$s(n)\approx a_1 s(n-1)+a_2 s(n-2)+\ldots+a_p s(n-p) \qquad \text{(Equation 1)}$$

where $a_1$, $a_2$, . . . $a_p$ are Linear Prediction Coding (LPC) coefficients and p is the Linear Prediction Coding order. The difference between the speech sample and the predicted speech sample is known as the prediction residual r(n) having a similar periodicity as speech signal s(n). The prediction residual r(n) can be expressed as:

$$r(n)=s(n)-a_1 s(n-1)-a_2 s(n-2)-\ldots-a_p s(n-p) \qquad \text{(Equation 2)}$$

which can be re-written as $$s(n)=r(n)+s_1 s(n-1)+a_2 s(n-2)+\ldots+a_p s(n-p) \qquad \text{(Equation 3)}$$

A closer examination of Equation 3 reveals that a current speech sample can be broken down into a predictive portion $a_1 s(n-1)+a_2 s(n-2)+\ldots+a_p s(n-p)$ and an innovative portion r(n). In some cases, the coded innovation portion is called the excitation signal or e(n) 106. It is the filtering of the excitation signal e(n) 106 by a synthesizer or a synthesis filter 108 that produces the reconstructed speech signal s'(n) 110.

To ensure that voiced and unvoiced speech segments are accurately reproduced, the excitation signal e(n) 106 is created through a linear combination of the outputs from an adaptive codebook 112 and a fixed codebook 102. The adaptive codebook 112 generates signals that represent the periodicity of the speech signal s(n). In this embodiment, the contents of the adaptive codebook 112 are formed from previously reconstructed excitations signals e(n) 106. These signals repeat the content of a selectable range of previously sampled signals that lie within adjacent subframes. The content is stored in memory. Due to the high-degree of correlation that exists between the current and previous adjacent subframes, the adaptive codebook 112 tracks signals through selected adjacent subframes and then uses these previously sampled signals to generate the entire or a portion of the current excitation signal e(n) 106.

The second codebook used to generate the entire or a portion of the excitation signal e(n) 106 is the fixed codebook 102. The fixed codebook primarily contributes the non-predictable or non-periodic portion of the excitation signal e(n) 106. This contribution improves the approximation of the speech signal s(n) when the adaptive codebook 112 cannot effectively model non-periodic signals. When noise-like structures or non-periodic signals exist in a sound track because of rapid frequency variations in voiced speech or because transitory noise-like signals mask voiced speech, for example, the fixed codebook 102 produces a best approximation of these non-periodic signals that cannot be captured by the adaptive codebook 112.

Figure 2:
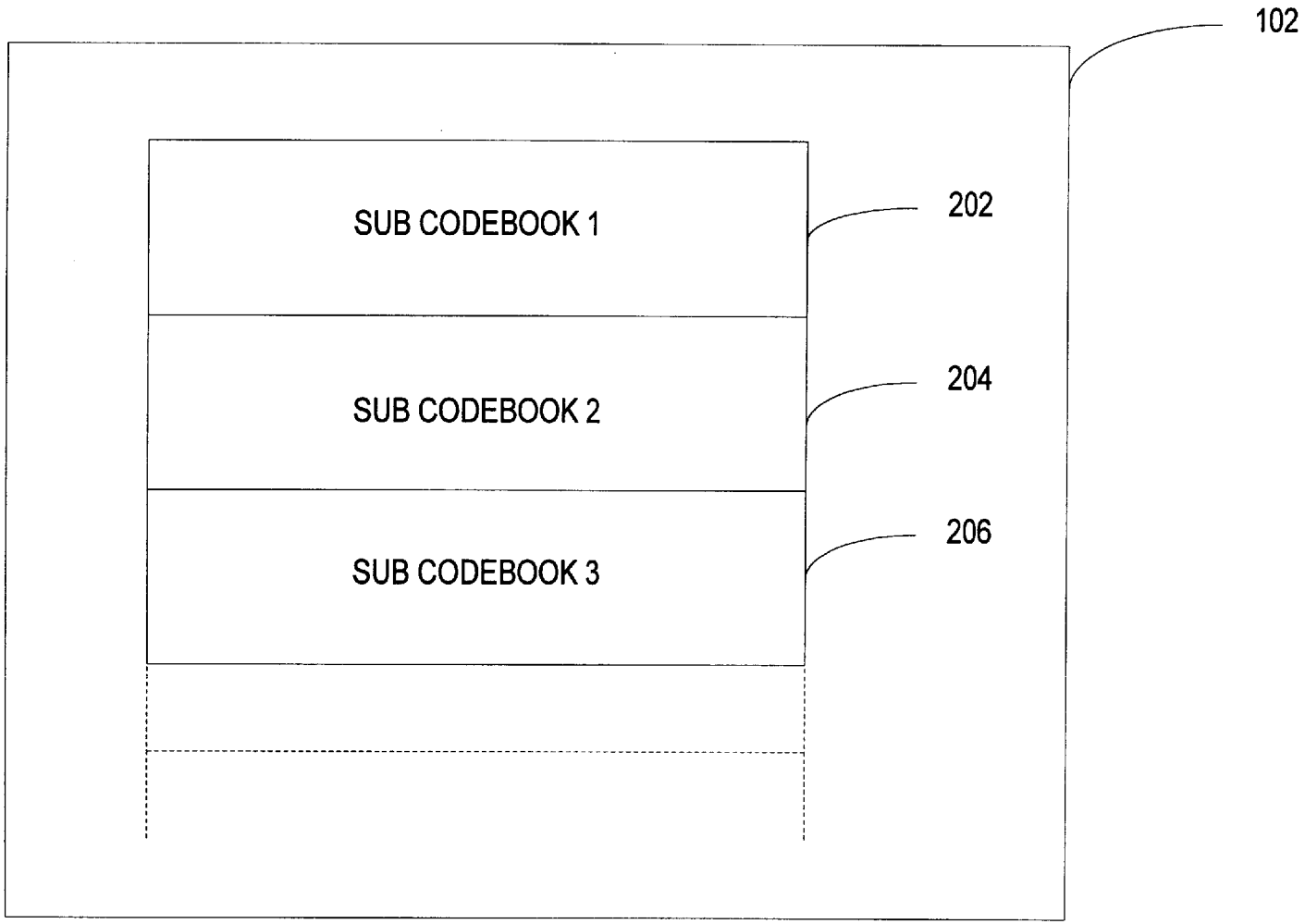
FIG. 2 illustrates a fixed codebook of FIG. 1.

The overall objective of the selection of codebook entries in this embodiment is to create the best excitations that approximate the perceptually important features of a current speech segment. To improve performance, a modular codebook structure is used in this embodiment that structures the codebooks into multiple sub codebooks. Preferably, the fixed codebook 102 is comprised of at least three sub codebooks 202–206 as illustrated in FIG. 2. Two of the fixed sub codebooks are pulse codebooks 202 and 204 such as a 2-pulse sub codebook and a 3-pulse sub codebook. The third codebook 206 may be a Gaussian codebook or a higher-pulse sub codebook. Preferably, the level of coding further refines the codebooks, particularly defining the number of entries for a given sub code book. For example, in this embodiment, the speech coding system differentiates "periodic" and "non-periodic" frames and employs full-rate, half-rate, and eighth-rate coding. Table 1 illustrates one of the many fixed sub codebook sizes that may be used for "non-periodic fames," where typical parameters, such as pitch correlation and pitch lag, for example, can change rapidly.

TABLE 1

Fixed Codebook Bit Allocation for Non-periodic Frames

| SMV[1] CODING ATE | SUB CODEBOOKS | SIZE |
|---|---|---|
| Full-Rate Coding | 5-pulses ($CB_1$) | $2^{21}$ |
| | 5-pulses ($CB_2$) | $2^{20}$ |
| | 5-pulses ($CB_3$) | $2^{20}$ |

TABLE 1-continued

Fixed Codebook Bit Allocation for Non-periodic Frames

| SMV[1] CODING ATE | SUB CODEBOOKS | SIZE |
|---|---|---|
| Half-Rate Coding | 2-pulse ($CB_1$) | $2^{14}$ |
| | 3-pulse ($CB_2$) | $2^{13}$ |
| | Gaussian ($CB_2$) | $2^{13}$ |

[1]Selectable Mode Vocoder

In "periodic frames," where a highly periodic signal is perceptually well represented with a smooth pitch track, the type and size of the fixed sub codebooks may vary from the fixed codebooks used in the "non-periodic frames." Table 2 illustrates one of the many fixed sub codebook sizes that may be used for "periodic fames."

TABLE 2

Fixed Codebook Bit Allocation for Periodic Frames

| SMV CODING RATE | SUB CODEBOOKS | SIZE |
|---|---|---|
| Full-Rate Coding | 8-pulses ($CB_1$) | $2^{30}$ |
| Half-Rate Coding | 2-pulse ($CB_1$) | $2^{12}$ |
| | 3-pulse ($CB_2$) | $2^{11}$ |
| | 5-pulse ($CB_3$) | $2^{11}$ |

Other details of the fixed codebooks that may be used in a Selective Mode Vocoder (SMV) are further explained in the co-pending patent application entitled: "System of Encoding and Decoding Speech Signals" by Yang Gao, Adil Beyassine, Jes Thyssen, Eyal Shlomot, and Huan-yu Su that was previously incorporated by reference.

Following a search of the fixed sub codebooks that yields the best output signals, some enhancements $h_1$, $h_2$, $h_3$, . . . $h_n$ are convoluted with the outputs of the pulse sub codebooks to enhance the perceptual quality of the modeled signal. These enhancements preferably track select aspects of the speech segment and are calculated from subframe to subframe. A first enhancement $h_1$ is introduced by injecting a high frequency noise into the pulse outputs that are generated from the pulse sub codebooks. It should be noted that the high frequency enhancement $h_1$ generally is performed only on pulse sub codebooks and not on the Gaussian sub codebooks.

Figure 3:
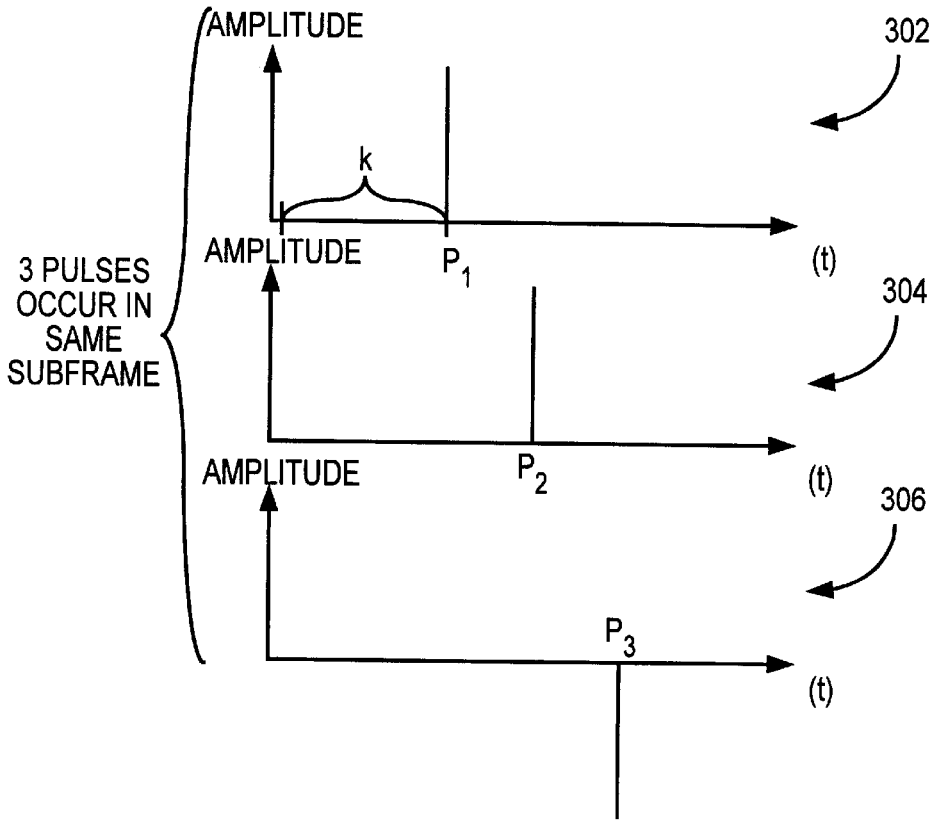
FIG. 3 illustrates sectional views of a part of a pulse of the fixed codebook of FIG. 1 in the time-domain.
Figure 4:
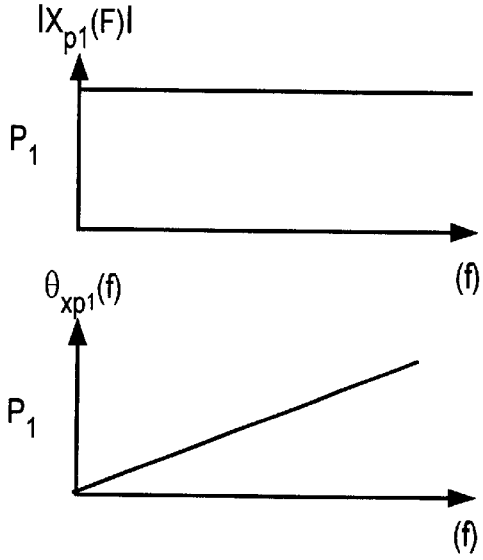
FIG. 4 illustrates the impulse response of a first pulse $P_1$ of FIG. 3 in the frequency-domain.
Figure 5:
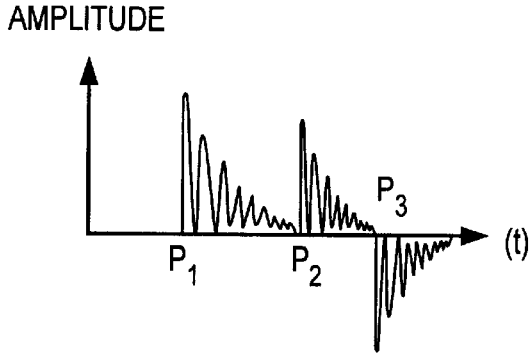
FIG. 5 illustrates the injection of a modified high frequency noise into the pulse excitations of FIG. 3 in the time-domain.

FIG. 3 illustrates an exemplary output $Y_p(n)$ of a fixed pulse sub codebook. To simplify the explanation, only three output pulses $P_1$, $P_2$, and $P_3$ 302–306 are illustrated in a single subframe. Of course, any number of pulses $P_n$ can be enhanced in a single or multiple subframes. The three pulses $P_1$, $P_2$, and $P_3$ 302–306 are positioned within a sub frame which has an exemplary time interval between 5–10 milliseconds. In the frequency-domain, pulses $P_1$, $P_2$, and $P_3$ 302–306 have a flat magnitude and a substantially linear phase (the magnitude and phase of $P_1$ in the frequency-domain are illustrated in FIG. 4). In the $h_1$ enhancement, a time-domain high frequency noise signal is added to $P_1$, $P_2$, and $P_3$ 302–306 by convoluting $P_1$, $P_2$, and $P_3$ with an $h_1(n)$. The product of the convolution is shown in FIG. 5.

Figure 6:
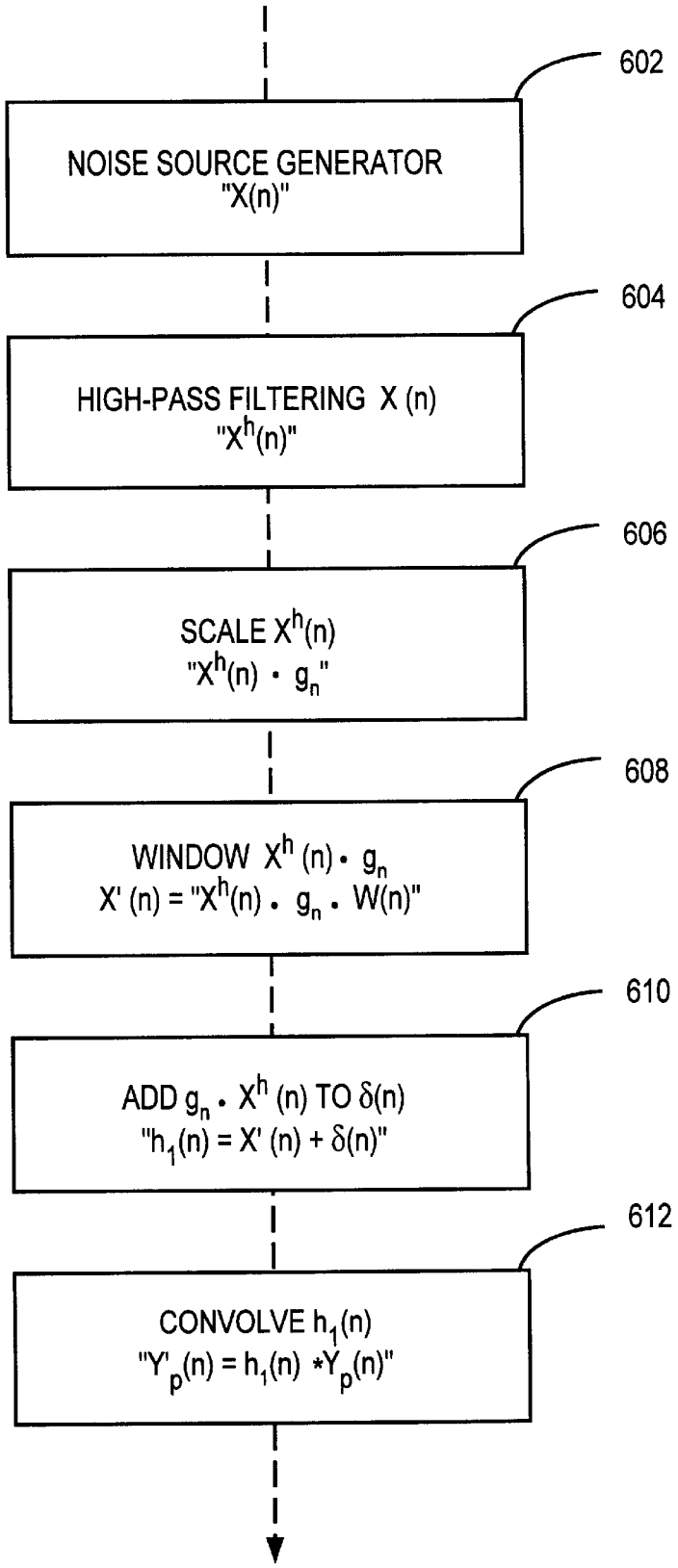
FIG. 6 is a flow diagram of an enhancement of FIG. 1.

FIG. 6 is a flow diagram of the $h_1$ enhancement that can be convoluted with the excitation output of any pulse codebook to enhance the perceptual quality of a reconstructed speech signal s'(n). At step 602, a noise source generates a white Gaussian noise X(n). Preferably, the white Gaussian noise has a substantially flat magnitude in the frequency-domain. At step 604, the white Gaussian noise X(n) may be filtered by a high-pass filter. The cut-off frequency of the high pass filter may be defined by the desired perceptual qualities of the speech segment s(n). At step 606, the filtered noise $X^h(n)$ is scaled by a programmable gain factor $g_n$ that also can be a fixed or an adaptive gain factor in alternative embodiments. At step 608, the noise $X^h(n)\cdot g_n$ is windowed with a smooth window W(n) (e.g., a half Hamming window) of length L of samples w(i). Preferably, the window W(n) attenuates the noise $X^h(n)\cdot g_n$ to a length of $h_1(n)$. At steps 610 and 612, the modified noise is injected into the output $Y_p(n)$ of the pulse sub codebook as illustrated in FIG. 5 and Equations 4 and 5. Preferably, delta of n of Equation 4, δ(n), is a single unit pulse that has a value of one at n=0 and has a value of zero at all other values of n (i.e., n≠0).

$$h_1(n)=X^h(n)\cdot g_n\cdot W(n)+\delta(n) \quad \text{(Equation 4)}$$

$$Y'_p(n)=h_1(n)*Y_p(n) \quad \text{(Equation 5)}$$

Figure 7:
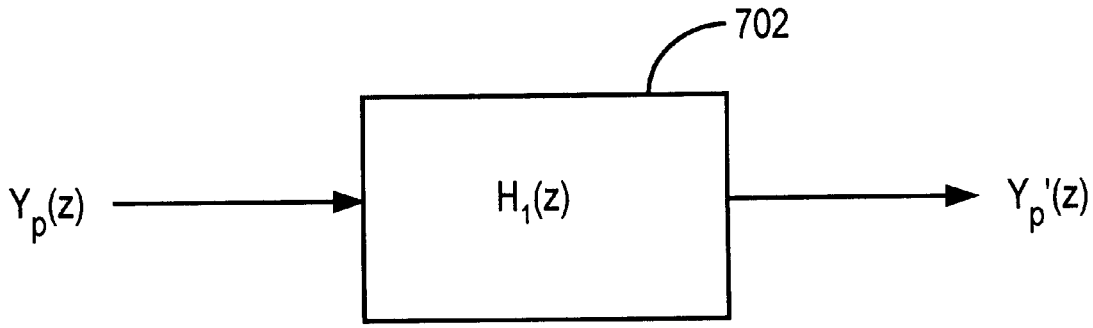
FIG. 7 illustrates a discrete implementation of the enhancement of FIG. 1.

Of course, the first enhancement $h_1$ also can be implemented in the discrete-domain through a convolver having at least two ports or means 702 comprising a digital controller (i.e., a digital signal processor), one or more enhancement circuits, one or more digital filters, or other discrete circuitry, for example. These implementations illustrated in FIG. 7 can be written as follows:

$$Y'_p(z)=H_1(z)\cdot Y_p(z) \quad \text{(Equation 6)}$$

From the foregoing description it should be apparent that the addition of a decaying noise to an output of a pulse codebook also could be added prior to the occurrence of a pulse output. Preferably, memory retains the $h_1$ enhancement of one or more previous subframes. When $h_1$ is not generated before the occurrence of a pulse, a selected previous $h_1$ enhancement can be convoluted with the pulse codebook output before the occurrence of the pulse output.

The invention is not limited to a particular coding technology. Any perceptual coding technology can be used including a Code Excited Linear Prediction System (CELP) and an Algebraic Code Excited Linear Prediction System (ACELP). Furthermore, the invention should not be limited to a closed-loop search used in an encoder. The invention may also be used as a pulse processing method in a decoder. Furthermore, prior to a search of the pulse sub codebooks, the $h_1$ enhancement may be incorporated within or made unitary with the sub codebooks or the synthesis filter 108.

Many other alternatives are also possible. For example, the noise energy can be fixed or adaptive. In an adaptive noise embodiment, the invention can differentiate voiced speech using different criteria including the degree of noise like content in a high frequency portion of voiced speech, the degree of voice content in a sound track, the degree of unvoiced content in a sound track, the energy content in a sound track, the degree of periodicity in a sound track, etc., for example, and generate different energy or noise levels that target one or more selected criteria. Preferably, the noise levels model one or more important perceptual features of a speech segment.

The invention seamlessly provides an efficient coding system and a method that improves the encoding and the decoding of perceptually important features of speech signals. The seamless addition of high frequency noise to an excitation develops a high perceptual quality sound that a listener can come to expect in a high frequency range. The invention may be adapted to post-processing technology and may be integrated within or made unitary with encoders, decoders, and codecs.

While various embodiments of the invention have been described, it will be apparent to those of ordinary skill in the art that many more embodiments and implementations are possible that are within the scope of this invention. Accordingly, the invention is not to be restricted except in light of the attached claims and their equivalents.

What is claimed is:

1. A speech communication system comprising:

a first codebook that characterizes a speech excitation segment;

a second codebook that characterizes a speech excitation segment;

a convolver electrically connected to an output of the second codebook; and a synthesizer electrically connected to an output of the convolver and an output of the first codebook, the convolver being configured to inject high frequency noise into an output of the second codebook for voiced speech segments.

2. A speech coding system comprising:

a first codebook that characterizes a speech excitation segment;

a second codebook that characterizes a speech excitation segment;

a convolver connected to an output of the second codebook; and a synthesizer connected to an output of the convolver and an output of the first codebook, the convolver being configured to inject high frequency noise into an output of the second codebook for voiced speech segments.

3. The system of claim 2 where the first codebook comprises an adaptive codebook.

4. The system of claim 2 where the second codebook comprises a fixed codebook.

5. The system of claim 2 where the convolver comprises at least a two-port device configured to convolve two signals.

6. The system of claim 2, where the convolver comprises a high pass filter connected to a white noise source, the high pass filter being configured to pass a high frequency portion of a generated white noise.

7. The system of claim 2 where the convolver is configured to convolve an impulsive response containing a modified noise and an output signal produced by the second codebook.

8. The system of claim 2 where the synthesizer comprises a synthesis filter.

9. The system of claim 2 further comprising a scalar where the convolver is connected to the output of the second codebook and an input of the scalar.

10. The system of claim 2 where the system comprises a Code Excited Linear Prediction System.

11. The system of claim 2 where the system comprises an eXtended Code Excited Linear Prediction System.

12. The system of claim 2 where the convolver comprises a white noise source.

13. The system of claim 2 where the convolver injects the high frequency noise into an output of a pulse codebook.

14. The system of claim 2 where the convolver is configured to inject a modified white noise into the output of the second codebook.

15. The system of claim 14 where the convolver comprises an enhancement circuit configured to inject the modified white noise.

16. The system of claim 2 where the noise comprises an adaptive noise.

17. The system of claim 2 where the noise comprises a fixed noise.

18. The system of claim 2 where the first and the second codebooks, the convolver, and the synthesizer are provided in at least one of an encoder and a decoder.

19. A speech coding system comprising:

a fixed codebook that characterizes a speech segment;

an adaptive codebook that characterizes the speech segment;

means configured to inject a high frequency noise into an output of the fixed codebook for voiced speech segments; and a synthesis filter connected to an output of the injecting means.

20. The system of claim 19 where the means convolves a windowed high frequency noise.

21. The system of claim 19 where the means comprises a filter.

22. The system of claim 19 where the means comprises a high-pass filter.

23. The system of claim 19 where the means comprises a convolver.

24. The system of claim 19 where the means is connected to the output of the fixed codebook and an input of a summing circuit.

25. The system of claim 19 where the means and the fixed codebook are a unitary device.

26. The system of claim 19 where the means and the synthesis filter are a unitary device.

27. A method for speech coding comprising:

forming a first excitation signal by selecting an output from a first codebook;

forming a second excitation signal by selected an output from a second codebook;

generating a decaying high frequency noise;

combining the high frequency noise with the second excitation signal for voice speech segments to produce a third excitation signal; and combining the first excitation signal with the third excitation signal to produce a fourth excitation signal that generates a speech segment.

28. The method of claim 27, where the second codebook comprises a pulse codebook.

29. The method of claim 27 further comprising filtering the fourth excitation signal with a synthesis filter.

30. The method of claim 27 where the act of combining comprises convolving.

31. The method of claim 27 where the act of generating a decaying high frequency noise comprises generating a white noise, filtering the white noise with a high pass filter, and windowing a filtered noise with a smooth window.

32. The method of claim 31 where the window comprises a programmable window.

33. The method of claim 28 where the pulse codebook comprises a fixed pulse codebook, the first codebook comprising an adaptive codebook.

* * * * *